US005672087A

United States Patent [19]

De La Paz Rizo et al.

[11] Patent Number: 5,672,087

[45] Date of Patent: Sep. 30, 1997

[54] UTILITY MODEL OF LAUNCHABLE AND ASSEMBLEABLE PIECES

[75] Inventors: Fabian De La Paz Rizo, Mexico City; Gabriel Martinez Ordoñez, Cuautitlan, both of Mexico

[73] Assignee: Sabritas, S.A. DE C.V., Mexico City, Mexico

[21] Appl. No.: 595,700

[22] Filed: Feb. 2, 1996

[30] Foreign Application Priority Data

Mar. 10, 1995 [MX] Mexico ..... 95087

[51] Int. Cl.[6] ..... A63B 65/10

[52] U.S. Cl. ..... 446/46; 446/108; 446/114

[58] Field of Search ..... 446/34, 46, 48, 446/106, 108, 114, 116, 127, 111; 273/424, 425, 427, 428

[56] References Cited

U.S. PATENT DOCUMENTS

| | | | |
|---|---|---|---|
| 1,163,851 | 12/1915 | Pringle | 446/106 |
| 3,023,890 | 3/1962 | Scholten | 446/106 |
| 3,562,077 | 2/1971 | Raba . | |
| 3,731,422 | 5/1973 | McFarland . | |
| 3,813,841 | 6/1974 | Tsurumi . | |
| 3,959,915 | 6/1976 | Kettlestrings . | |
| 3,991,511 | 11/1976 | McAllister et al. | 446/114 |
| 4,118,887 | 10/1978 | Appleman . | |
| 4,170,215 | 10/1979 | Kettlestrings . | |
| 4,222,361 | 9/1980 | Jackson . | |
| 4,261,135 | 4/1981 | Lehman . | |
| 4,265,454 | 5/1981 | Bayless | 273/427 |
| 4,329,807 | 5/1982 | Atkinson . | |
| 4,354,326 | 10/1982 | Mathews | 446/46 |
| 4,669,995 | 6/1987 | Lombard . | |
| 4,932,812 | 6/1990 | Schaaf . | |
| 4,984,556 | 1/1991 | Glass et al. . | |
| 5,100,358 | 3/1992 | Volgger | 446/116 |
| 5,163,862 | 11/1992 | Philips et al. | 446/114 |
| 5,516,114 | 5/1996 | Michlin et al. | 273/424 |

FOREIGN PATENT DOCUMENTS

| | | | |
|---|---|---|---|
| 540481 | 8/1959 | Belgium | 446/111 |
| 1243060 | 8/1960 | France | 446/114 |
| 136745 | 7/1913 | Germany . | |
| 568154 | 10/1957 | Italy . | |
| 605437 | 5/1960 | Italy | 446/111 |
| 6869 | 6/1994 | Mexico . | |
| 2031289 | 4/1980 | United Kingdom | 446/111 |
| 2054393 | 2/1981 | United Kingdom | 446/108 |

OTHER PUBLICATIONS

Playplax article, received in PTO Mar. 14, 1968.

*Primary Examiner*—Robert A. Hafer
*Assistant Examiner*—Jeffrey D. Carlson
*Attorney, Agent, or Firm*—Finnegan, Henderson, Farabow, Garrett & Dunner

[57] ABSTRACT

The present invention relates to flat pieces, preferably disks or chips of circular shape fabricated, of flexible plastic material, that have a series of slots or notches alongside their circumferential edges. One of these slots is bigger in size and of different configuration, which configuration makes possible the launching a first piece into the air with the help of a second piece which is used as a propeller. In addition, the small slots are used to create a great variety of structures or sets, by inserting a small slot of a first disk in a small slot of a second disk, and so on. The planar faces of the disks may be used to imprint any legend or drawing.

4 Claims, 4 Drawing Sheets

UTILITY MODEL OF LAUNCHABLE AND ASSEMBLEABLE PIECES

BACKGROUND OF THE INVENTION

The present invention refers to flat launchable pieces that are used for personal entertainment, as an educational item, or for amusement. The flat pieces may adopt a variety of shapes, such as circular, square, hexagonal, octagonal, etc., or irregular shapes, though the present invention makes particular reference to circular pieces such as disks, chips or tazos (Registered Mark).

Various types of disks or chips are known in the art from the popular "Frisbees" or throw plates, to the games of chips, disks, and sets of blocks that can be assembled to produce several different structures.

Many of these disks or chips have been patented. For example, Italian Patent No. 568154 describes circular and polygonal disks with slots which can be assembled by placing the disks perpendicular to each other and placing the slot of one disk within the slot of a second disk, and so on.

U.S. Pat. No. 3,959,915 to Kettlestrings describes a circular disk that has a curved peripheral border with a slot. A rectangular impeller of flexible material engages the slot in order to impell the disk by the unflexing of the impeller, so that the disk may be launched.

U.S. Pat. No. 3,562,077 to Raba describes a component with three joined lobes, wherein the lobes have three slots positioned alongside the outer edge of each of the lobes. As can be seen in the patent, a first component can be assembled with a second component by setting both components perpendicular to each other and placing the slot of the first component within the slot of the second component.

U.S. Pat. No. 4,118,887 to Appleman describes a take-apart toy that includes a body which has a plurality of appendages that are removable. Each one of these appendages has a slot that can fit in any of the slots of the body by means of teeth. The appendages and the body joined together form the figure of a doll that resembles a clown. Additionally, the appendages have, at the same time, slots that can be used to attach other appendages.

German Patent No. 136745 describes a component that includes four semi-circular disks interconnected alongside their edges at right angles. Each of the semicircular disk has convex slots at its edges in order to connect the component, with another similar component and thus is able to form structures.

Mexican Industrial Design Registration No. 6869 describes a slotted element for multiple use comprising an essentially flat body which is, and generally circular in shape. The slotted element is utilized to make fried foods, sweets, or structural elements using sufficiently rigid material. The slotted element is also used to make racks, cabinets, living spaces, and furniture, as well as accessories that stimulate the creative development of infants and the skill-development of adults.

However, none of the above-mentioned references teaches or discloses the novel characteristics of the flexible pieces of the present invention.

SUMMARY OF THE INVENTION

The present invention refers to flat pieces, preferably disks or chips of circular shape, made of flexible material such as plastic. Each disk or chip has a series of slots or notches that are spaced at equal distances alongside the circumferential edge and extend radially toward the center of the disk. One of these slots or notches is wider, longer, and has a different configuration from the remaining slots which are smaller and have a U-shape. This different configuration allows the launching of the disks or chips into the air, thus providing the pieces of this invention with a function which is different, more advantageous, and not found in the inventions of the prior art.

In this manner, a disk may be utilized to launch another disk in the air in a rotational manner. To obtain this result, a slot of a second disk is inserted into the larger slot of a first disk. This second disk is thus left in contact with one of the walls of the slot and is supported against the lower apex of said slot. When a force is applied to the first disk while, at the same time, maintaining the connection with the second disk, the second disk is flexed. When the first disk is freed the first disk is launched into the air in a rotational manner.

Furthermore, the small slots may be utilized to form a great variety of structures or sets by inserting a small slot of a first disk into a small slot of a second disk, successively with "n" disks, in such way that the final structure may have the shape and complexity desired by the user.

Additionally, it is possible to imprint any type of legend drawing or cartoon on the flat planar surfaces of each one of the disks, making them attractive enough to be a collector's item.

In order to better illustrate the invention a set of drawings is attached, which figures are described below.

DETAILED DESCRIPTION OF THE PREFERRED EMBODIMENTS

Figure 1:
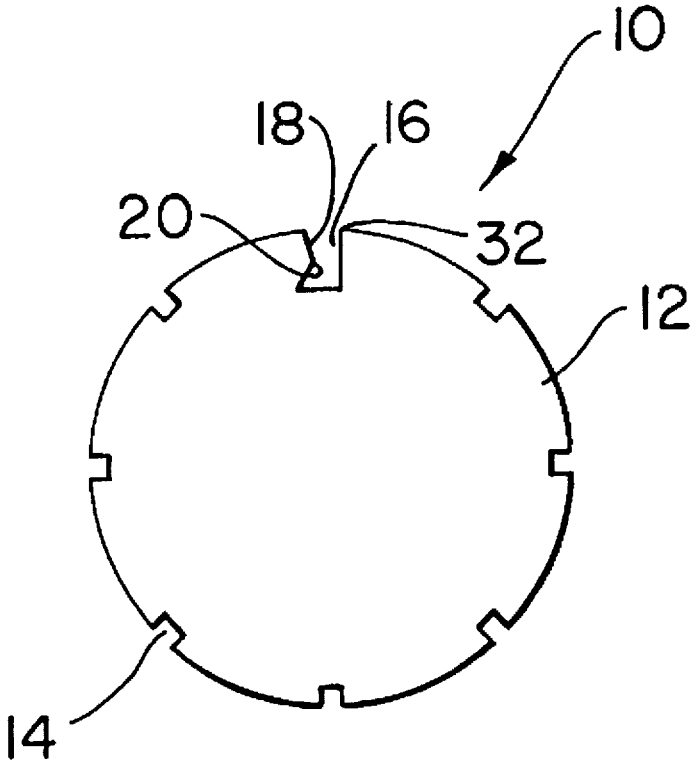
FIG. 1, is the a top plan view of one of the assembleable and launchable pieces of the present invention. The bottom plan view is a mirror image of FIG. 1.

With reference to the drawings, FIG. 1 illustrates disk 10, showing the preferred embodiment of the invention. Disk 10 is fabricated of flexible plastic and its two planar surfaces 12 are substantially flat.

As can be seen in FIG. 1, disk 10 has in its circumferential edge seven small slots 14 which have a U-shape, and a slot 16 which is bigger than the previous slots, all slots extending radially toward the center of the disk.

In the preferred embodiment of this invention, slot 16 has an irregular configuration, with two right-angle edges and one edge in V-shape, this V-shape edge forming two faces 18 and 20 that facilitate the launching of one of the pieces, with the help of a second piece.

Figures 4, 5:
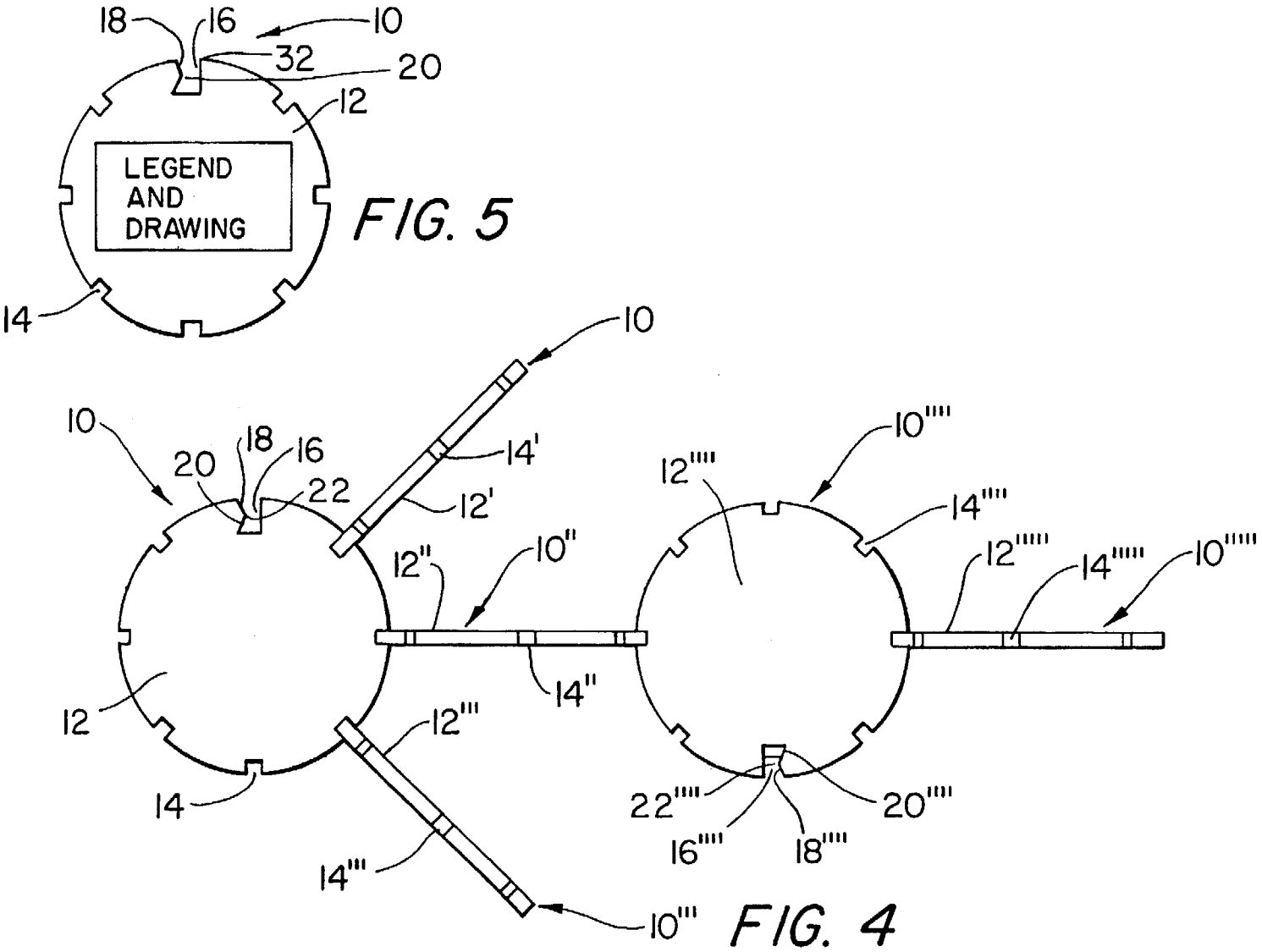
FIG. 4 is a top plan view of a plurality of pieces joined together by means of one or several of their smaller slots.
FIG. 5 is a top plan view showing a legend and drawing imprinted on the planar surface of the piece. The bottom view is identical to FIG. 5.

The two flat surfaces 12 of the disk may be utilized to imprint any legend or drawing, such as that of a well-known character, a cartoon or the like, as shown in FIG. 5.

Figure 2:
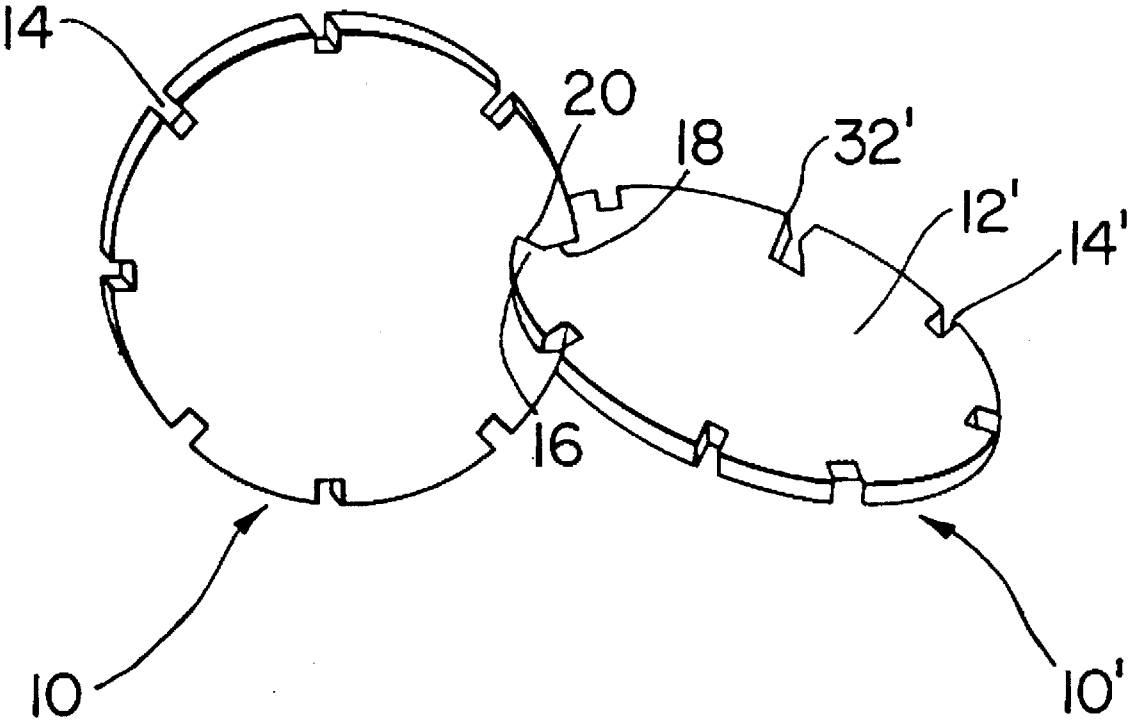
FIG. 2 is a perspective view of two pieces of the present invention, where one of the pieces is inserted in the wider slot of another piece.

In FIG. 2, the coupling of two pieces is illustrated configured to launch a first piece into the air utilizing a second piece as the propulsor.

As can be seen in FIG. 2, in the bigger slot of first piece 10 is inserted any part of the edge of a second piece 10', in such way that both pieces are left substantially perpendicular.

Figure 3:
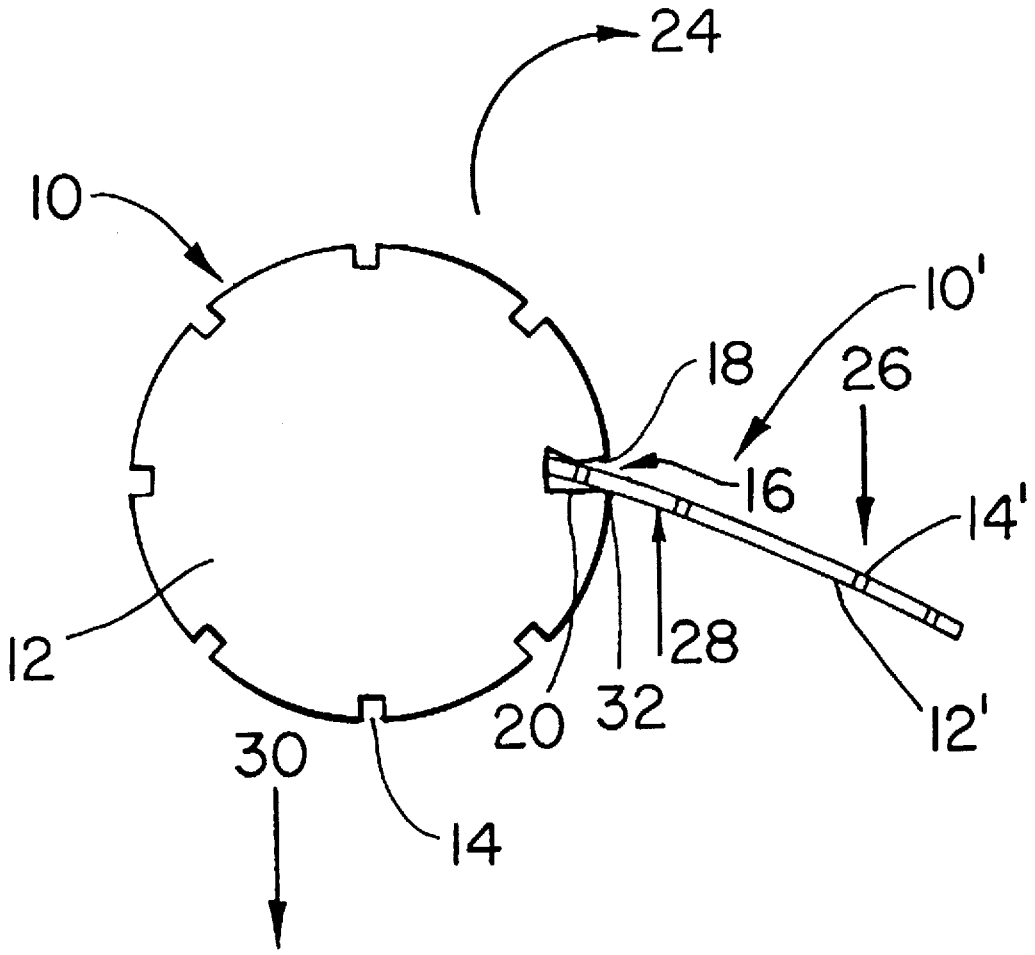
FIG. 3 is the side elevation view of the pieces shown in FIG. 2.

As can be seen in FIG. 3, first piece 10 is kept in a fixed position with one hand, while second piece 10' is placed with the other hand within the bigger slot of first piece 10. When second piece 10' is inserted in slot 16 of the first piece, face 20 of the V-shape edge and the lower apex 32 of slot 16 cooperate to apply a couple to piece 10 couples and and to ensure piece 10 does not slide outside at the moment force is applied in direction 30.

Keeping the above disposition, disk 10 may be pulled or pushed with one of the hands in direction 30, flexing piece 10', while at the same time a place of support is maintained with one of the fingers of the other hand at point 28. This way, when piece 10 is reteased, while maintaining piece 10' in fixed position, piece 10 is launched into the air in a rotational manner in direction 24.

In a second embodiment of the invention (not shown), slot 16 may have a U-shape and greater dimensions than the rest of the small slots 14. The launching is also possible with this embodiment in a similar way to the one described before. This, however, is less advantageous as there is no point of support here for piece 10 to receive the application of a couple, thus creating a tendency to slide at the moment it is pulled and making the launching more difficult.

With reference to FIG. 4, it can be seen that the flexible pieces of the present invention may be utilized to form a great variety of structures. As can be seen in this figure, the pieces are placed perpendicular to one another and slot 14 of first disk 10 is inserted in the small slot 14' of second disk 10'. Likewise, another small slot 14 of first disk 10 is inserted in a small slot 14" of a third disk. 10" and so on with disks 10'", 10"", etc.

This way a great variety of structures can be created that, depending on the number of pieces being used and the shape the user may wish to give them, may make an endless number of shapes, to meet the user's taste.

This invention has been described in terms of its preferred embodiments, but it should be apparent to someone skilled in the art that the game pieces can have other common shapes, such as polygonal and irregular, which would function in a manner similar to the circular shape, though presenting a different appearance. It should be understood that this invention is also susceptible to variations and modifications, within the scope of the claims listed below.

We claim:

1. An assembly and launching toy comprising a plurality of similar disk-like pieces made of a resilient material, each having a perimeter and a plurality of joining slots extending from the perimeter towards the center of the piece, the slots being of a width to frictionally engage a joining slot of another piece and retain the pieces in a joined condition, so that desired structures can be assembled by so joining an arbitrary number of pieces; each piece also having at least one undercut launching slot of larger dimensions than the joining slots, extending from the perimeter towards the center of the piece, said undercut launching slot having four adjacent edge surfaces, a first pair of the four edge surfaces being perpendicular to one another and forming a fulcrum where one of said edge surfaces meets the perimeter, and a second pair of the four edge surfaces being V-shaped, forming a point so that bottom edge surface of the second pair of edge surfaces diverges from said point to increase the width of the undercut launching slot in a direction towards the center of the piece and a top edge surface of the second pair of edge surfaces diverges from said point toward the perimeter, whereby a perimeter edge of a second game piece pivots on said fulcrum and is retained in the launching slot by said bottom diverging edge surface when a user inserts the perimeter edge of the second game piece into said launching slot and applies a force to flex the second game piece for launching, and whereby said top and bottom diverging edge surfaces are disposed at a sufficient distance from the opposing perpendicular edge surface to allow the launching slot to disengage without friction the perimeter edge of the second game piece upon release for launch.

2. The toy according to claim 1, wherein the pieces are fabricated from a flexible plastic material.

3. The toy according to claim 1, wherein said joining slots are U-shaped, having two parallel edges, and a third edge perpendicular to the parallel edges.

4. The toy according to claim 1, wherein the pieces are of circular shape.

* * * * *